US005107237A

United States Patent [19]

Peterson

[11] Patent Number: 5,107,237

[45] Date of Patent: Apr. 21, 1992

[54] CIRCUIT BREAKER APPARATUS

[75] Inventor: Robert Peterson, Bridgton, Me.

[73] Assignee: Texas Instruments Incorporated, Dallas, Tex.

[21] Appl. No.: 614,901

[22] Filed: Nov. 16, 1990

[51] Int. Cl.[5] ..... H01H 9/20

[52] U.S. Cl. ..... 335/170; 335/253

[58] Field of Search ..... 335/253, 254, 168, 169, 335/170, 171

[56] References Cited

U.S. PATENT DOCUMENTS 4,623,860 11/1986 Baker et al. ..... 335/170

*Primary Examiner*—George Harris

*Attorney, Agent, or Firm*—John A. Haug; James P. McAndrews; Melvin Sharp

[57] ABSTRACT

A sub-miniature circuit breaker particularly suited for use with aircraft simulators is shown which has the same look and feel of circuit breakers used in aircraft. The circuit breaker has a push-pull/actuator and ball latch mechanism and a solenoid operated trip mechanism.

5 Claims, 1 Drawing Sheet

OPEN POSITION

OPEN POSITION

CLOSED POSITION

CIRCUIT BREAKER APPARATUS

Figure 1:
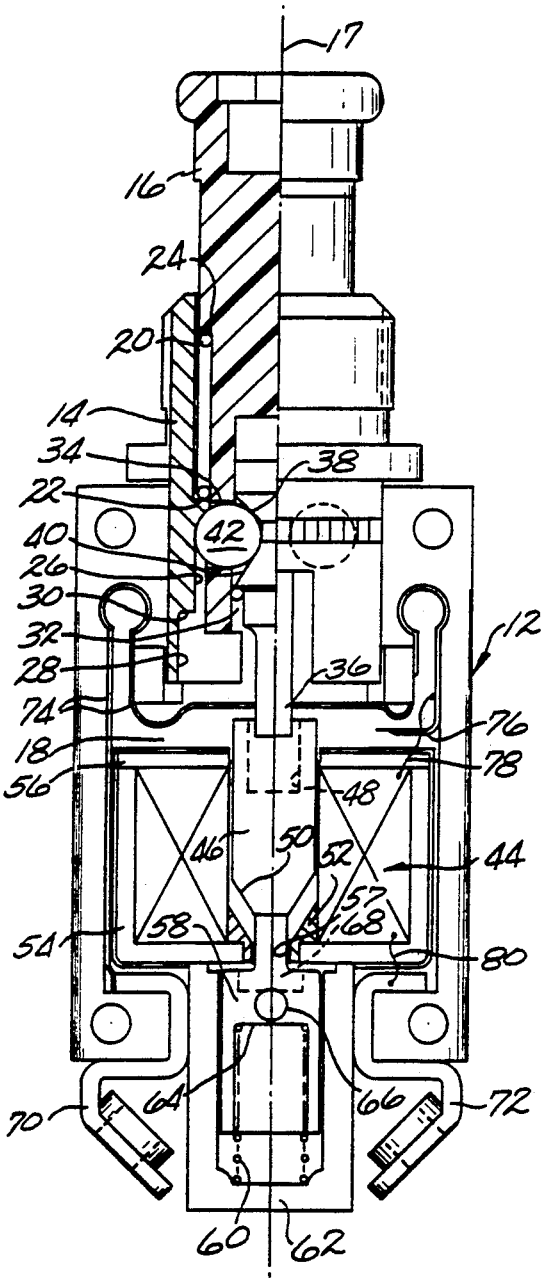

This invention relates generally to circuit breakers and more particularly to sub-miniature circuit breakers having a ball latch mechanism of the type employed for aircraft circuit breakers.

It is common practice in aircraft training simulators to use conventional thermal or magnetic aircraft circuit breakers to achieve the desired look and feel of circuit breakers employed in actual aircraft. However, in simulators the circuit breakers are adapted to be tripped open automatically by the application of a current, typically 28 volt applied DC signal. This results in either too high a current drain or excessive trip times or too large a package to physically fit into the simulator panel layout.

SUMMARY OF THE INVENTION

It is an object of the present invention to provide a conventional ball latch type circuit breaker which can be tripped with a low current draw. Another object of the invention is the provision of an aircraft type circuit breaker adapted for use in an aircraft simulator and having essentially the same exterior envelope and actuation characteristics of a circuit breaker employed in aircraft.

Briefly, in accordance with the invention, a housing of essentially the same external configuration and size of a conventional sub-miniature aircraft circuit breaker includes a push button actuator/ball carrier connected to a ball latch mechanism of the same type used in such aircraft circuit breakers. An electromagnetic coil or solenoid is disposed in the housing with a movable core element aligned with an intermediate actuator latching plunger and an auxiliary switch plunger. An auxiliary switch spring provides an upward bias which is transmitted through the core of the coil to the actuator latching plunger to maintain the balls in the latched position. In this position the actuator/ball carrier engages a transversely extending movable conductive element and forces it into engagement with a stationary conductive element to close a circuit through the circuit breaker terminals. When a low current signal is applied to this circuit the coil develops an electromotive force which offsets the auxiliary switch spring thereby allowing the actuator spring to unlatch the balls and permit the actuator/ball carrier to move upwardly and allow the movable conductive element to move out of engagement with the stationary conductive element and open the circuit. Contacts of the auxiliary switch are in engagement when the movable conductive element is out of engagement with the stationary conductive element and, vice versa, the contacts are out of engagement when the movable conductive element is in engagement with the stationary conductive element.

Figure 2:
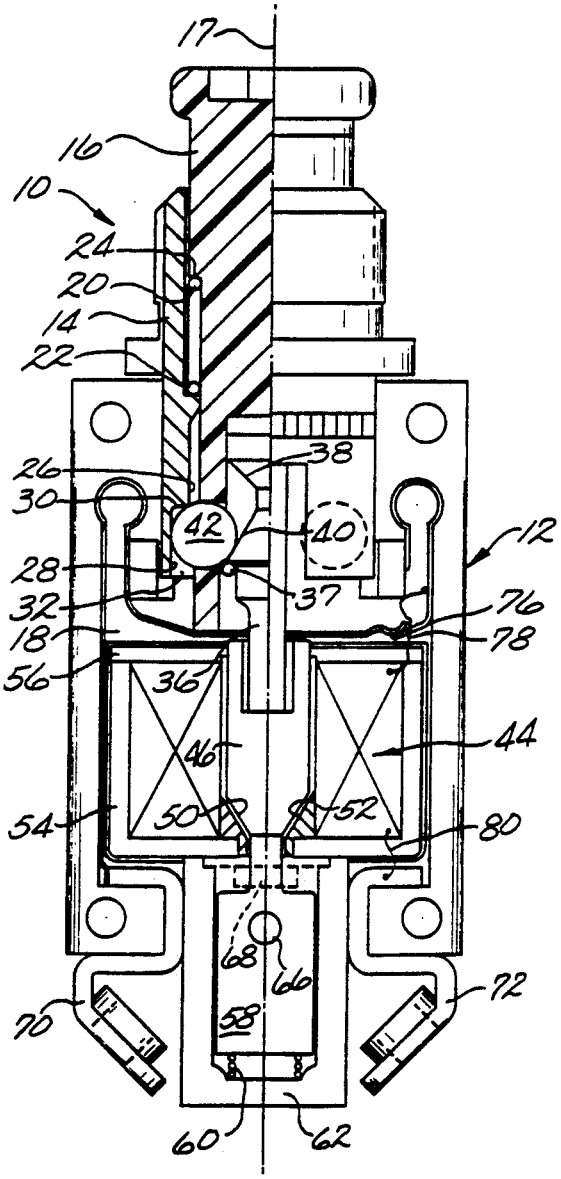

Other objects, advantages and details of the circuit breaker of the invention appear in the following detailed description of the preferred embodiment, the detailed description referring to the drawings in which:

FIG. 1 is a front elevational view, partly in cross section of a circuit breaker made in accordance with the invention shown in the open position; and FIG. 2 is a view similar to FIG. 1 but with the circuit breaker in the closed position.

Circuit breaker 10 comprises a housing 12 having essentially the same external envelope as conventional sub-miniature thermal and magnetic circuit breakers used in aircraft. In addition, in order to provide the same look and feel of an aircraft circuit breaker, the breaker of the invention uses the same actuator/ball latch mechanism that is in common use with aircraft circuit breakers, as shown in greater detail, for example, in U.S. Pat. No. 3,564,174, assigned to the assignee of the present invention. The actuator/ball latch mechanism comprises a bushing 14 in which is slidably mounted a push button actuator 16 adapted to slide along a longitudinal axis 17 toward and away from a cavity 18 formed in housing 12. An actuator spring 20 is recessed between a shoulder 22 in bushing 14 and shoulder 24 of push button actuator 16 urging push button actuator 16 in a direction away from cavity 18.

Bushing 14 has a first upper diameter portion 26 and a second lower and larger diameter portion 28 with a shoulder 30 formed therebetween. Push button/actuator 16 has a longitudinally extending bore or recess 32 formed at its distal end and a plurality of ball receiving openings 34 in the tubular side wall of the distal portion of push button/actuator 16.

An actuator plunger 36 is slidably received along longitudinal axis 17 in bore 32 and is formed with first and second frusto-conical cam surfaces 38, 40 respectively inverted relative to one another to form an open space therebetween for reception of latching balls 42. Latching balls 42 have a diameter selected to be greater than the thickness of the tubular side wall of the distal portion of actuator 16 for a purpose to be described in further detail below.

An electromagnetic coil or solenoid 44 is disposed in cavity 18 and includes a core 46 slidably movable along axis 17. Core 46 has a recess portion 48 at one end which receives an end of actuator plunger 36 and a truncated conical portion 50 at its opposite end which is adapted to engage stop 52 having a configuration complimentary to portion 50. Although stop 52 is shown having a conical surface configuration it will be realized that a butt configuration can also be employed if desired. A conventional solenoid frame 54 and cap 56 is placed around the coil to concentrate the flux in a known manner. Stop 52 is formed with an aperture 57 therethrough which receives the upper end of an auxiliary switch plunger 58. An auxiliary switch coil spring 60 is disposed between the bottom wall 62 of housing 12 and a spring seat 64 formed in plunger 58 and places an upward bias on plunger 58. A movable auxiliary switch contact 66 is mounted on plunger 58 and is adapted to move into and out of engagement with stationary contact 68 dependent upon movement of plunger 58.

A line terminal 70 and a load terminal 72 extend outwardly of housing 12 and are adapted to be connected to circuitry in a control panel of an aircraft simulator in the same manner as a conventional aircraft circuit breaker is connected to circuitry in a control panel of an aircraft. Terminal 70 is electrically connected within housing 12 to one end of a elongated electrical conductor 74 which extends upwardly within cavity 18 and has a movable distal portion which extends transversely across cavity 18 between solenoid 44 and actuator/ball carrier 16. The second end of conductive element 74 is adapted to move into and out of engagement with a stationary electrical conductor 76. As noted in FIG. 2 stationary conductor 76 has some flexibility to enhance electrical connection with movable conductor 74. Conductor 76 is electrically connected to one end of the coil 44 as by pigtail 78 and the other end of the coil is electrically connected in a similar manner to terminal 72 via pigtail 80.

As seen in FIG. 2, the actuator/ball carrier 16 is maintained in the closed position by means of auxiliary spring 60 which biases the ball latch plunger 36 upwardly through the auxiliary switch plunger 58 and the solenoid core 46. The ball latch plunger 36 thereby indexes the latching balls 42 outwardly and into engagement with second diameter portion 28 of bushing 14 and bushing latching shoulder 30. In the closed position, with the solenoid unenergized, the bias of auxiliary switch spring 60 is sufficient to maintain the push button/actuator 16 locked in the closed position against the opposing bias acting on balls 42 from actuator spring 20 through the ball carrier portion of push button/actuator 16. The push button/actuator 16 will remain in the closed position as long as the plunger bias acting on the ball latch is greater than the opposing ball carrier bias.

In the open position the auxiliary switch movable contact 66 is held in engagement with the stationary auxiliary contacts 68 by action of auxiliary switch spring 60 and auxiliary switch plunger 58.

When push button/actuator 16 is moved to the closed position the plunger 36 moves downwardly and causes solenoid core 46, auxiliary switch plunger 58 with movable contact 66 to move down out of engagement with stationary auxiliary switch contact 68. This transfers the auxiliary switch spring bias to the latching plunger 36 and latches push button/actuator 16 in its downward position. In addition, the solenoid coil 44 is enabled by closing of conductive elements 74, 76 as the ball carrier portion of the push button/actuator 16 engages movable conductive element 74 in its downward travel and remains enabled as long as the actuator 16 is latched in the closed position.

When the selected or prescribed voltage signal is impressed across terminals 70, 72 the solenoid is energized and a magnetic field is established across the working gap of core 46 and stop 52 which acts to oppose the latching bias of auxiliary switch spring 60. The number of turns in the solenoid coil is selected to both limit the current drain and provide axial force to oppose the bias of auxiliary switch spring 60 sufficiently to cause the latching balls 42 to release and the push button/actuator 16 to return to the open position.

The circuit breaker of the instant invention can be made to work on either DC or AC signals. It is within the purview of the invention to employ various configurations for the components of the circuit breaker. For example, conductive element 76 could be non-flexible if desired. Further, if more upward bias on actuator plunger 36 is desired a spring 37 could be placed between frame cap 56 and plunger 36.

It should be understood that although the preferred embodiment of the circuit breaker has been described by way of illustration, this invention includes all modifications and equivalents falling within the scope of the appended claims.

I claim:

1. Circuit breaker apparatus comprising a housing forming a cavity therein, a bushing mounted in the housing, the bushing having a first longitudinally extending bore extending into the cavity, a push button member having a portion movable within the bore along the longitudinal axis of the bore, actuator spring means biasing the push button member in a direction away from the housing, the portion having a tubular side wall at a distal end thereof forming a recess open to the cavity, at least one ball receiving opening in the tubular side wall, the bushing having an inner end disposed within the cavity and being formed with a second longitudinally extending bore larger than the first bore with a latching shoulder formed between the first and second bores, an actuator plunger having a recessed area formed by two frusto-conical portions inverted relative to one another to form first and second cam surfaces, the plunger movable within the recess of the push button member portion along the longitudinal axis, a ball received in each ball receiving opening, the ball having a diameter larger than the thickness of the tubular side wall, a movable elongated electrically conductive element extending transversely across the cavity generally perpendicular to the longitudinal axis and movable into and out of engagement with a stationary conductive element, Claim 1 continued:

an electromagnetic coil disposed below the conductive elements and having a core movable along the longitudinal axis, an auxiliary plunger movable along the longitudinal axis, an auxiliary spring biasing the auxiliary plunger into engagement with the core, the push button member when depressed engaging the movable conductive element and moving it into electrical engagement with the stationary conductive element and the auxiliary spring transmitting a force through the auxiliary plunger, the core and the actuator plunger to the at least one ball urging the ball into the second bore in engagement with the latching shoulder and whereby a current in the coil will produce an EMF force offsetting the bias of the auxiliary spring and allowing the actuator spring to move the push button upwardly forcing the at least one ball into the recessed area of the actuator plunger.

2. Circuit breaker apparatus according to claim 1 further including a movable auxiliary contact mounted on the auxiliary plunger and an auxiliary stationary contact mounted in the housing, upward motion of the auxiliary plunger being limited by engagement of the movable contact with the stationary contact.

3. Circuit breaker apparatus according to claim 1 in which the stationary conductive element is resilient.

4. Circuit breaker apparatus according to claim 1 in which the core has a recess formed in its top surface which receives the bottom portion of the actuator plunger.

5. Circuit breaker apparatus according to claim 1 in which the core has a bottom surface portion with a frusto-conical configuration.

* * * * *